US005319859A

United States Patent [19]

Smith

[11] Patent Number: 5,319,859

[45] Date of Patent: Jun. 14, 1994

[54] TUCK AND POINT TEMPLATE FOR MAKING SHARK'S TEETH

[76] Inventor: Eloise T. Smith, 1309 16th Ave., Conway, S.C. 29526

[21] Appl. No.: 43,215

[22] Filed: Mar. 26, 1993

[51] Int. Cl.[5] ..... B43L 13/00

[52] U.S. Cl. ..... 33/563; 33/566; 33/11

[58] Field of Search ..... 33/562, 563, 566, 11, 33/12, 13, 2 R, 574, 575, 577, 486, 487, 1 G

[56] References Cited

U.S. PATENT DOCUMENTS 3,090,533 5/1963 Claeys et al. ..... 33/563
3,369,303 2/1968 Henry ..... 33/563
3,849,886 11/1974 Weyrick et al. ..... 33/2 R
4,986,005 1/1991 Grippi et al. ..... 33/13 X

*Primary Examiner*—William A. Cuchlinski, Jr.
*Assistant Examiner*—Alvin Wirthlin
*Attorney, Agent, or Firm*—Rogers & Killeen

[57] ABSTRACT

A template to aid in the process of making shark's teeth in material. The template is placed over a sheet of material and the apertures and slots are used as a template for marking dots and lines on the material. The lines mark the places on the material which need to be cut in the process of forming shark's teeth. The dots mark the place on the material which will become the point of the shark's teeth so that the material can be tucked at the correct place to produce uniform shark's teeth.

3 Claims, 2 Drawing Sheets

TUCK AND POINT TEMPLATE FOR MAKING SHARK'S TEETH

BACKGROUND OF THE INVENTION

The invention is a template to be used in the process of forming shark's teeth in a sheet of material. Shark's teeth are decorative triangles of tucked material which are formed in a sheet of material. Typically rows of shark's teeth are formed on a sheet of material in a pattern. The sheet of material can then be used to make an article of clothing, or can be used to make useful articles such as pillow cases, quilts, covers, etc.

The process of making shark's teeth requires that a series exacting measurements be made, and marked on a sheet of material. These marks are then used as a template to cut and tuck the material in the process of forming the shark's teeth. The whole process of making shark's teeth is demanding and requires a heavy investment of time and effort to create intricate patterns.

Prior to the development of the present invention it was necessary to use a ruler or a measuring tape to make the measurements and marks on the material. A single wrong measurement could result in destruction of an intricate pattern, and the error is typically discovered only after many rows of the shark's teeth have already been formed. When such an error is made the material must be abandoned and the whole process must begin again.

It is accordingly an object of the present invention to simplify the process of marking a sheet of material in the process of making shark's teeth. Use of the template of the present invention eliminates measuring errors and greatly speeds up the marking process since no individual measurements must be made. In addition, the present invention allows the user to create even, consistent shark's teeth since the measurements are exact.

These and many other objects of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 4:
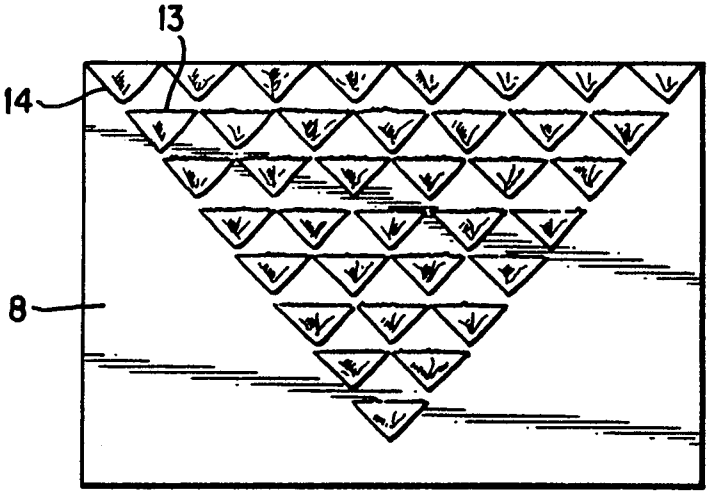
FIG. 4 is a pictorial view of a sheet of material with a design of shark's teeth.

The method of producing shark's teeth in a sheet of material will be described with references to FIGS. 2–4.

Figure 2:
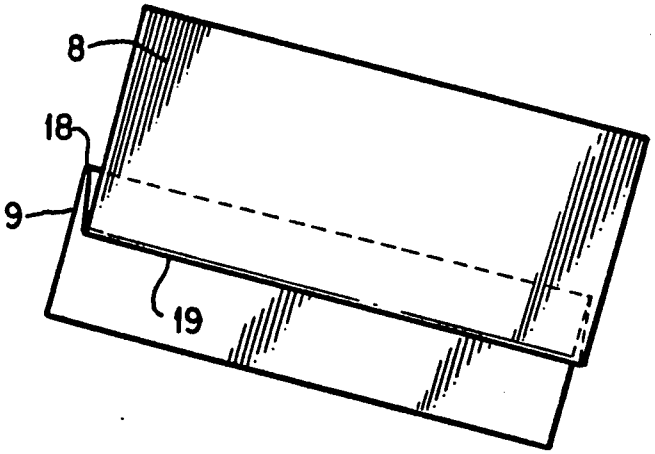
FIG. 2 is a pictorial view of a sheet of material folded on the first step of the process.

With reference to FIG. 2, a sheet of material 8 is first given a fold 9. The material is then typically starched and ironed in this position so it will lay flat as shown in FIG. 3.

Figure 3:
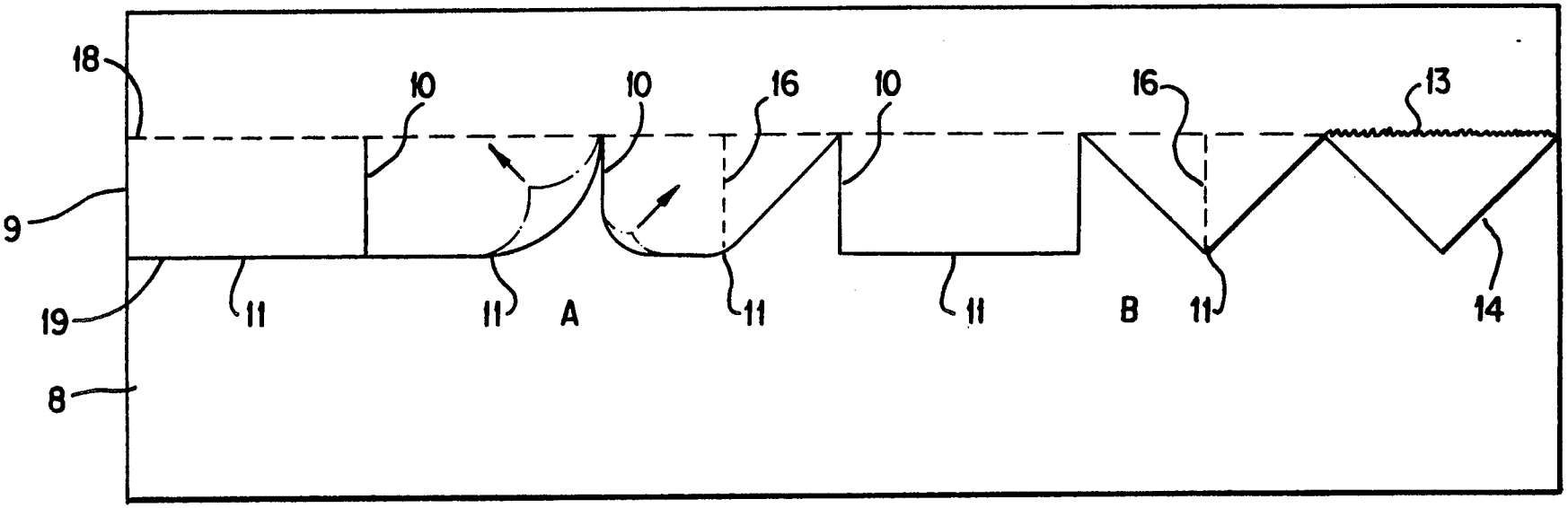
FIG. 3 is a pictorial view of a sheet of material with a fold which has been ironed flat, on which lines and dots have been marked, illustrating the formation of shark's teeth.

With reference to FIG. 3, the fold 9 in the sheet of material 8 is then marked with lines 10 and dots 11. The lines 10 indicate areas on the fold 9 which will be later cut and the dots 11 indicate the positions on the fold which will become the points of the shark's teeth. The fold 9 is cut along the lines 10 which were previously marked.

For each shark's tooth, the fold 9 along the lines 10 is tucked underneath the top of the fold toward the tuck line 18 as shown at A so that the edges of the material along the outline 10 meet underneath the fold along the dotted line 16 as shown at B. Basting or a washable glue or other similar substance can be used to keep the tucks in position. Once all of the cut sections have been tucked under the fold for a single row, the row can be pressed with an iron or given a few stitches to keep the tucks in place for the next step.

The edges of the tucks which were previously cut are then sown into position along the top of the fold with a line of stitches 13 which may be decorative. In this manner a line of shark's teeth 14 is formed in the material.

Additional rows of shark's teeth can be formed in a material using the procedure just described. The additional rows can be arranged so that a pattern of shark's teeth is created on the material as shown for example by the triangular pattern shown in FIG. 4.

Creating a pattern of shark's teeth in a sheet of material requires that exacting measurements be made and marked upon each row of the material. The process of marking the lines and dots on the fold of a sheet of material to produce a row of shark's teeth is made easier with the template of the present invention.

Figure 1:
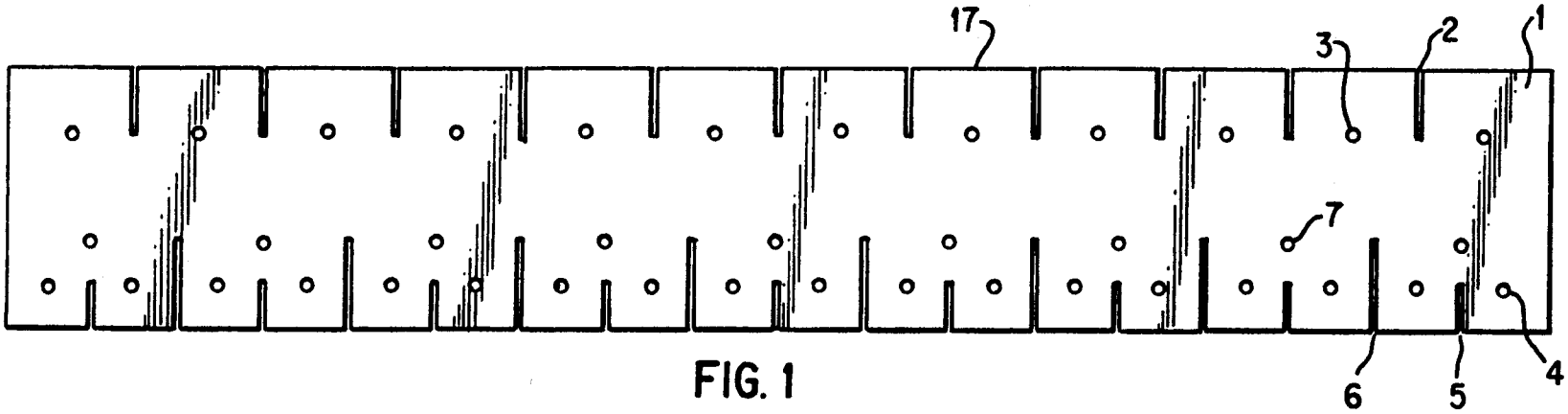
FIG. 1 is a pictorial view of the template.

Once a sheet of material has been given a fold and ironed flat, as shown in FIG. 3, the template shown in FIG. 1 is placed over the fold and the top edge of the template 17 is aligned with the top of the fold 18. As shown in FIG. 3, lines 10 are marked on the fold 9 which run from the top edge of the fold 18 to the bottom of the fold 19 using the slots 2 in the template 1. Dots 11 are marked on the bottom edge of the tuck 19 using the apertures 3 in the template 1. The lines 10 indicate the places to cut the fold to make shark's teeth, and the dots 11 indicate the positions on the fold 9 which will become the points of the shark's teeth.

A different set of proportioned slots and apertures can be formed on the same edge of the template and slots and apertures can be formed on both edges of the template. With reference to FIG. 1, if the top edge of the template were used, lines would be marked on the material using the slots 2, and dots would be marked on the material using the aperture 3. In the preferred embodiment the length of the slots 2 are approximately one half the distance between adjacent slots. This would give a row of evenly formed shark's teeth or a certain proportion. If the bottom edge of the template is used, one of two different proportioned shark's teeth can be created. If the apertures 4 and the slots 5 and 6 are used, shark's teeth of smaller proportions can be created. If the apertures 7 and the slots 6 are used, then shark's teeth of a larger proportion can be created. In the preferred embodiment length of the smaller slots 5 are approximately equal to one quarter the distance between adjacent smaller slots 5 and the length of the larger slots 6 are approximately equal to one half the distance between adjacent larger slots 6. Use of the template shown in FIG. 1 can allow the user to create 3 different sizes of shark's teeth e.g., 1.5 inches, 1.0 inches and 0.5 inches in width.

In the preferred embodiment the template is made of a transparent plastic and has lines printed on the face of the template to aid in the positioning of the template over the material. The template could also be made of any appropriate material such as wood, metal, fiberglass, etc. In the preferred embodiment the template is approximately 18 inches long, approximately 3 inches wide and approximately ⅛ of an inch thick. The edges and corners of the template, and all apertures and slots are rounded to avoid snagging material placed under the template.

ADVANTAGES AND SCOPE OF THE INVENTION

Use of the template allows a person to quickly mark all of the lines and dots for a row of shark's teeth without needing to measure anything with a measuring stick, a ruler, or a tape measure. Since the template has slots and apertures physically cut into the template, it is easier to quickly mark a sheet of material in exactly the correct positions than if a ruler or tape measure had been used. As a result the shark's teeth will be more even and better proportioned. Since there is no possibility for a marking error using the template, no waste or loss of time will result from the need to discard a partially formed pattern of shark's teeth.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. A template for marking material to aid in the formation of shark's teeth, comprising:

an elongated, flat transparent member having two lateral edges each adapted to be manually positioned along the edge of the material which is to be cut and tucked in the formation of shark's teeth, said member having along one of said lateral edges a first plurality of evenly spaced parallel slots extending normally from said one lateral edge toward the longitudinal axis of said member a distance approximately one-half the spacing between said slots, said member having a first plurality of evenly spaced apertures aligned with the closed end of said first plurality of slots, each of said apertures located approximately equidistant between the closed ends of two immediately adjacent slots;

said member having along the other lateral edge a second plurality of evenly spaced parallel slots extending normally from said other lateral edge toward the longitudinal axis of said member a distance approximately one-half the spacing between said slots, the spacing between said second plurality of slots having a predetermined relationship with the spacing between said first plurality of slots;

said member having a second plurality of evenly spaced apertures aligned with the closed end of said second plurality of slots, each of said second plurality of apertures being located approximately equidistant between the closed ends of the two immediately adjacent ones of said second plurality of slots;

said member having along said other lateral edge a third plurality of evenly spaced parallel slots extending normally from said other lateral edge toward the longitudinal axis of said member a distance approximately one-quarter the spacing between said third plurality of slots, the spacing between said third plurality of slots having a predetermined relationship with the spacing between said first plurality of slots;

said member having a third plurality of evenly spaced apertures aligned with the closed end of said third plurality of slots, and equidistant between the immediately adjacent second and third plurality of slots on the other lateral edge;

each of said slots having sufficient width and each of said apertures having a sufficient opening to permit the insertion of a marking instrument therein to mark the material underlying said slots for cutting in the formation of shark's teeth and to mark the material underlying said apertures at points to which material is to be tucked in the formation of shark's teeth.

2. The template of claim 1 wherein the spacing between said second plurality of slots is approximately four-thirds the spacing between said first plurality of slots.

3. The template of claim 1 wherein the spacing between said third plurality of slots is approximately four-thirds the spacing between said first plurality of slots.

* * * * *